US008840428B2

(12) United States Patent
Omae et al.

(10) Patent No.: US 8,840,428 B2
(45) Date of Patent: Sep. 23, 2014

(54) INSULATING STRUCTURE FOR L-SHAPED TERMINAL

(75) Inventors: Takashi Omae, Makinohara (JP); Kazuki Zaitsu, Makinohara (JP)

(73) Assignee: Yazaki Corporation, Tokyo (JP)

( * ) Notice: Subject to any disclaimer, the term of this patent is extended or adjusted under 35 U.S.C. 154(b) by 66 days.

(21) Appl. No.: 13/515,821

(22) PCT Filed: Nov. 29, 2010

(86) PCT No.: PCT/JP2010/071229

§ 371 (c)(1),
(2), (4) Date: Jun. 14, 2012

(87) PCT Pub. No.: WO2011/074396

PCT Pub. Date: Jun. 23, 2011

(65) Prior Publication Data

US 2012/0252272 A1 Oct. 4, 2012

(30) Foreign Application Priority Data

Dec. 16, 2009 (JP) ..... 2009-284920

(51) Int. Cl.
*H01R 9/05* (2006.01)

(52) U.S. Cl.
USPC ..... 439/582; 439/607.56

(58) Field of Classification Search
USPC ..... 439/582, 731, 607.56, 607.41
See application file for complete search history.

(56) References Cited

U.S. PATENT DOCUMENTS 5,285,511 A * 2/1994 Akkapeddi et al. ..... 385/89
5,882,228 A 3/1999 Kobler
6,506,075 B2 * 1/2003 Chiran et al. ..... 439/607.01
7,530,848 B2 * 5/2009 Nagashima et al. ..... 439/607.41
7,597,580 B1 * 10/2009 Advey et al. ..... 439/383
8,251,762 B2 * 8/2012 Maier et al. ..... 439/892
2001/0049225 A1 12/2001 Chiran et al.
2003/0203677 A1 10/2003 Spiegel et al.

(Continued)

FOREIGN PATENT DOCUMENTS

CN 1349288 A 5/2002
JP 2000-299170 A 10/2000

(Continued)

OTHER PUBLICATIONS

International Search Report dated Feb. 8, 2011, issued for PCT/JP2010/071229.

(Continued)

*Primary Examiner* — Hien Vu
(74) *Attorney, Agent, or Firm* — Edwards Wildman Palmer LLP

(57) ABSTRACT

To electromagnetically-shield an L-shaped terminal in a compact and reliable manner while easily and securely fixing the L-shaped terminal, there is employed an insulating split inner housing having an L-shaped terminal receiving portion including an electric-contact-portion-side receiving portion covering an electric contact portion of the L-shaped terminal connected to a shielded wire and a wire-connection-portion-side receiving portion covering a wire connection portion of the L-shaped terminal, the electric-contact-portion-side receiving portion is covered by a conductive shield shell, the wire-connection-portion-side receiving portion is covered by a conductive housing connected to the shield shell and to a shield portion of the shielded wire, and the L-shaped terminal is insulated by the inner housing from the shield shell and the conductive housing.

6 Claims, 7 Drawing Sheets

(56) References Cited

U.S. PATENT DOCUMENTS

| | | | | |
|---|---|---|---|---|
| 2004/0014358 | A1 | 1/2004 | Leve | |
| 2005/0118858 | A1 | 6/2005 | Matsui et al. | |
| 2009/0137153 | A1 * | 5/2009 | Yoshioka et al. | 439/607.24 |

FOREIGN PATENT DOCUMENTS

| | | | |
|---|---|---|---|
| JP | 2003-115357 | A | 4/2003 |
| JP | 2005-129391 | A | 5/2005 |
| JP | 3114071 | U | 9/2005 |

OTHER PUBLICATIONS

Supplementary European Search Report dated Apr. 11, 2013, issued for the corresponding European patent application No. 10837425.7.

Office Action mailed Sep. 17, 2013, issued for the corresponding Japanese patent application No. 2009-284920 and English translation thereof.

Chinese Office Action dated Mar. 31, 2014 issued for corresponding Chinese Patent Application No. 201080057136.6.

* cited by examiner

INSULATING STRUCTURE FOR L-SHAPED TERMINAL

TECHNICAL FIELD

The present invention relates to an insulating structure for an L-shaped terminal, in which the L-shaped terminal connected to a shielded wire which carries high-voltage electric current is received within an inner housing with an excellent electrical insulation.

BACKGROUND ART

FIG. 13 shows one embodiment of a conventional shield structure for L-shaped terminal disclosed in Patent Literature 1.

In this structure, an L-shaped terminal 82 is crimped to a core wire 81*a* of a shielded wire 81 and is connected by bolting to an electrode 83 of a motor located under a vehicle floor. A conductive shield shell 85 is fixed by bolting to a grounded cover 84 of the motor, and the L-shaped terminal 82 is received inside the shield shell 85. A conductive braid 81*b* of the shielded wire 81 is connected to the shield shell 85 with a joint terminal 86 by bolting. Also, a joint terminal (not shown) for another shielded wire 81 is attached together to the joint terminal 86. The shield shell 85 and an insulating sheath 81*c* of the shielded wire 81 are covered by a rubber grommet 87 for waterproofing.

CITATION LIST

Patent Literature

Patent Literature 1

Japanese Patent Application Publication No. 2005-129391 (FIG. 1)

SUMMARY OF INVENTION

Technical Problem

However, for the conventional shield structure for L-shaped terminal described above, there is no insulator between the shield shell 85 and the L-shaped terminal 82. Therefore, it is necessary to provide a large space between the shield shell 85 and the L-shaped terminal 82, causing an increase in size of the structure of the shield shell 85 and the related components. Especially, there is a concern that, when such structure is applied to a shield connector (not shown), the size of the structure of the shield connector will be increased. Furthermore, there is a need for fixing the L-shaped terminal 82 in a simple and reliable manner without using bolting.

In view of the above-described problems, it is an object of the present invention to provide an insulating structure for L-shaped terminal which can electromagnetically shield an L-shaped terminal in a compact and reliable manner, and which can easily and securely fix the L-shaped terminal.

Solution to Problem

In order to achieve the above-described object, according to a first aspect, there is provided an insulating structure for L-shaped terminal including a single or a plurality of insulating split inner housings, wherein the insulating split inner housing is provided with a plurality of L-shaped terminal receiving portions including an electric-contact-portion-side receiving portion covering an electric contact portion of an L-shaped terminal connected to a shielded wire and a wire-connection-portion-side receiving portion covering a wire connection portion of the L-shaped terminal. A plurality of the electric-contact-portion-side receiving portions is covered and received by a conductive shield shell, and a plurality of the wire-connection-portion-side receiving portions is covered by a conductive housing connected to the shield shell and to a shield portion of the shielded wire. The L-shaped terminal is insulated by the inner housing from the shield shell and the conductive housing. The shield shell and tip end portions of the plurality of electric-contact-portion-side receiving portions projecting from the shield shell are covered by an insulating outer housing.

According to the above-described structure, the electric contact portion of the L-shaped terminal with respect to a mating terminal is covered by the electric-contact-portion-side receiving portion of the inner housing and is reliably insulated from the outer shield shell. At the same time, the wire connection portion of the L-shaped terminal with respect to the shielded wire is covered by the wire-connection-portion-side receiving portion (i.e. the one orthogonal to the electric-contact-portion-side receiving portion) of the inner housing and is reliably insulated from the outer conductive housing. Consequently, it is possible to locate the shield shell and the conductive housing close to the L-shaped terminal without creating a waste of space.

Furthermore, the L-shaped terminal can be easily fixed within the L-shaped inner housing without the need of using a locking means such as a locking lance. In other words, an axial (front-rear direction) movement of one portion, i.e. the electric contact portion, of the L-shaped terminal is prohibited by the wire-connection-portion-side receiving portion of the inner housing. At the same time, an axial (up-down direction) movement of the other portion, i.e. the wire connection portion, of the L-shaped terminal is prohibited by the electric-contact-portion-side receiving portion of the inner housing.

Furthermore, the shield shell and the shield portion (e.g. a braid) of the shielded wire are connected to the conductive housing. Thus, for example, the noise which has been entered from outside into the shield shell and the conductive housing is prevented from being transmitted to the L-shaped terminal, and the noise is grounded through the shield portion of the shielded wire. Thus, the current including no noise is carried from the L-shaped terminal to the mating terminal. A shield connector is formed by covering the shield shell with an insulating outer housing (in this case a packing may be provided if there is a need for waterproofing).

Moreover, according to a second aspect, each of the plurality of inner housings includes the single terminal receiving portion and is designed to split in a widthwise direction of the L-shaped terminal.

According to the above-described structure, the L-shaped terminal connected to the shielded wire is received in and insulated by the respective inner housings according to the number of shielded wires. The pair of split inner housings is locked with respect to each other by a locking portion.

Furthermore, according to a third aspect, the single inner housing includes the plurality of terminal receiving portions attached to each other in a parallel manner, and the inner housing is designed to split in a thickness direction of the L-shaped terminal.

According to the above-described structure, the L-shaped terminal is arranged one-by-one within the respective terminal receiving portions, and the respective L-shaped terminals are insulated by closing the pair of split inner housings in the thickness direction of the L-shaped terminal. The pair of split inner housings is locked with respect to each other by a locking portion.

Furthermore, according to a fourth aspect, the shield portion of the shielded wire is connected to the conductive housing through a shield terminal, and the shield terminal is arranged close to and along the wire-connection-portion-side receiving portion of the inner housing.

According to the above-described structure, the L-shaped terminal is insulated within the inner housing, thus the shield terminal for grounding is arranged close to the L-shaped terminal without creating a waste of space. Since the shield terminal is connected to the conductive housing, the shield terminal may be arranged close to or in contact with the conductive housing.

Advantageous Effects of Invention

According to the first aspect of the present invention, by insulating the entire L-shaped terminal with the L-shaped inner housing, the shield shell and the conductive housing can be arranged close to the L-shaped terminal and the inner housing in a space-saving manner Consequently, the L-shaped terminal can be electromagnetically shielded in a reliable manner with a compact structure, thus a compact shield connector can be obtained. In addition, by receiving the L-shaped terminal within the L-shaped inner housing, the movement (i.e. displacement) of the L-shaped terminal in the front-rear and up-down directions can be prevented. Thus, the L-shaped terminal can be easily and securely fixed using a simple and compact structure without a need of using a terminal locking means such as a locking lance and such.

According to the second aspect of the present invention, it is easy to suitable increase or decrease the number of the inner housings according to the number of shield wires used, i.e. the number of L-shaped terminal.

According to the third aspect of the present invention, by using the inner housing which has the integrally formed plurality of terminal receiving portions, the number of components related to the inner housing can be reduced while simplifying the structure and reducing the cost.

According to the fourth aspect of the present invention, since the L-shaped terminal is insulated by the inner housing, the shield terminal can be arranged close to the L-shaped terminal and to the inner housing in a space-saving manner.

DESCRIPTION OF EMBODIMENTS

Figure 1:
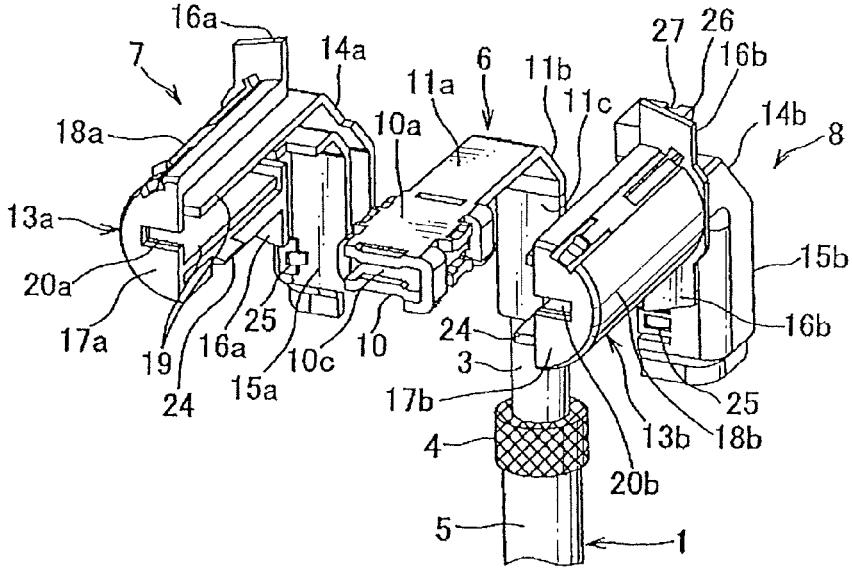
FIG. 1 is an exploded perspective view of a first embodiment of an insulating structure for L-shaped terminal according to the present invention.

FIG. 1 shows a first embodiment of an insulating structure for L-shaped terminal according to the present invention.

This insulating structure for L-shaped terminal is arranged so that an L-shaped terminal 6, which is made of conductive metal and connected to a core wire 2 (shown in FIG. 5) located at an end of a shielded wire 1, is received inside of an inner housing 9 (shown in FIG. 3) made of insulating resin and composed of a left-right pair of L-shaped split housings 7, 8. The inner housing 9 is arranged to split in a widthwise direction (i.e. a left-right direction) of the L-shaped terminal 6.

The L-shaped terminal 6 is a female-terminal and includes a female-type box-shaped electric contact portion 10, a horizontal base plate 11*a* continuous with the same plane as a base plate 10*a* corresponding to an upper face of the electric contact portion 10, a short slanted base plate 11*b* slanted downward from the horizontal base plate 11*a*, a vertical base plate 11*c* continuous with the slanted base plate 11*b*, and a pair of crimp pieces (which corresponds to a wire connection portion) 12 (shown in FIG. 5) formed on both left-right sides of the vertical base plate 11*c*. The electric contact portion 10 includes an elastic contact piece 10*b* (shown in FIG. 5) located inside the electric contact portion 10, and a horizontal slit-like, male-terminal insertion aperture 10*c* located at a front end of the electric contact portion 10. The crimp piece 12 is crimped and connected to the core wire 2 (shown in FIG. 5) of the shielded wire 1.

The shielded wire 1 is composed of an inner insulating sheath 3 covering the core wire 2, a braid (or a shield portion) 4 made of conductive metal and covering the inner insulating sheath 3, and an outer insulating sheath 5 covering the braid 4. The core wire 2 and the braid 4 are partially exposed, and the exposed braid 4 is folded back downward along a shield ring (not shown) made of conductive metal and mounted to the outer insulating sheath 5. Alternatively, it is possible to use a copper foil instead of the braid 4.

Figure 2A:
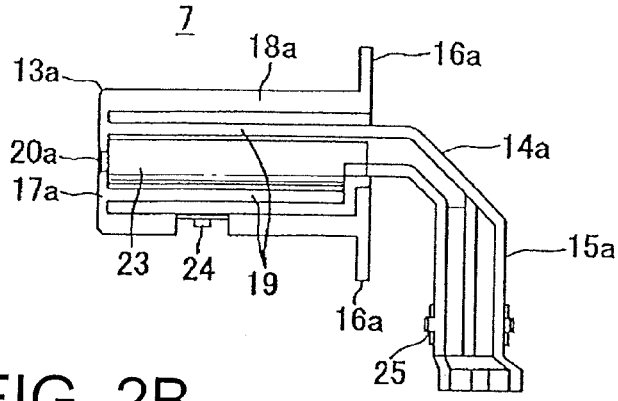
FIG. 2A is a side view of one embodiment of one split inner housing used in the insulating structure.
Figure 2B:
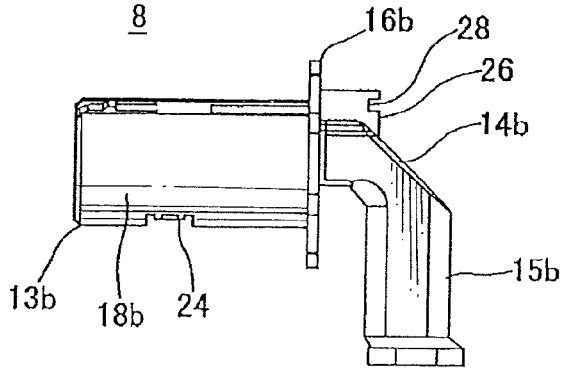
FIG. 2B is a side view of one embodiment of the other split inner housing used in the insulating structure.

As shown in FIG. 1, FIG. 2A and FIG. 2B, the respective split housings 7, 8 include a horizontal semicylinder portion 13*a*, 13*b*, a short, slanted rectangular gutter portion 14*a*, 14*b* extending from the semicylinder portion 13*a*, 13*b*, a vertical rectangular gutter portion 15*a*, 15*b* continuous with the slanted rectangular gutter portion 14*a*, 14*b*, and an upper and lower flanges 16*a*, 16*b* projecting from a rear end of the semicylinder portion 13*a*, 13*b*.

The semicylinder portion 13*a*, 13*b* is composed of a semicircular front wall 17*a*, 17*b* located at a front end, and a peripheral wall 18*a*, 18*b* having a semicircular cross-section. There are provided horizontal, parallely-arranged upper and lower walls 19 extending from the front wall 17*a*, 17*b* and arranged inside the semicylinder portion 13*a*, 13*b*. The upper and lower walls 19 are integrally formed with and continuous with the vertical rectangular gutter portion 15*a*, 15*b* via the slanted rectangular gutter portion 14*a*, 14*b*. Furthermore, there is provided a male-terminal insertion groove (or aperture) 20*a*, 20*b* arranged at a center of the front wall 17*a*, 17*b*. The male-terminal insertion groove 20*a*, 20*b* communicates with a space 23 formed between the upper and lower walls 19, and the space 23 communicates with a space inside the respective rectangular gutter portions 14*a*, 14*b*, 15*a*, 15*b*. The upper and lower flanges 16*a*, 16*b* are sandwiched and fixed between a later-described aluminum housing 21 (refer to FIG. 4) and an outer housing 22.

Figure 3:
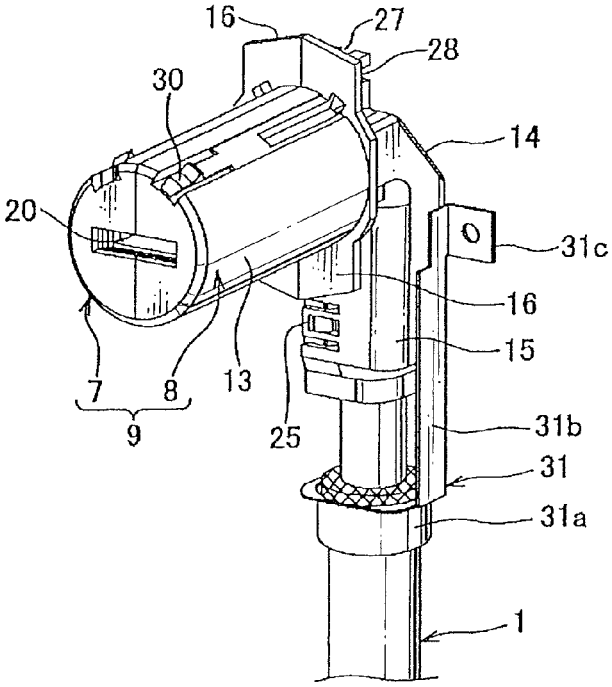
FIG. 3 is a perspective view of the insulating structure for L-shaped terminal.

As shown in FIG. 3, the left and right split inner housings 7, 8 are locked and fixed with respect to each other by a locking portion 24, 25 (shown in FIG. 1), such as a locking claw and a locking frame, provided at the semicylinder portion 13*a*, 13*b* (shown in FIG. 1) and the vertical rectangular gutter portion 15*a*, 15*b* (shown in FIG. 1). The semicylinder portions 13*a*, 13*b* are combined together to form a tubular portion 13 (which corresponds to an electric-contact-portion-side receiving portion). Furthermore, the rectangular gutter portions 14*a*, 14*b*, 15*a*, 15*b* are combined together to form a rectangular tubular portion 14, 15 (which corresponds to a wire-connection-portion-side receiving portion), respectively. The male-terminal insertion grooves 20*a*, 20*b* (shown in FIG. 1) are combined together to form a horizontal male-terminal insertion aperture 20. The respective upper and lower flanges 16*a*, 16*b* (shown in FIG. 1) are combined together to form a plate-like flange 16 having the same width as the tubular portion 13. The tubular portion 13 and the rectangular tubular portions 14, 15 together form a terminal receiving portion.

Referring to FIG. 1, the respective split housings 7, 8 are mounted to the L-shaped terminal 6 from the left-right sides, so that the L-shaped terminal 6 is received inside the upper and lower walls 24 in the tubular portion 13 and inside the rectangular tubular portions 14, 15. Thus, the electric contact portion 10 and the horizontal base plate 11*a* are received between the upper and lower walls 19 without backlash, while the vertical base plate 11*c* and the respective crimp pieces 12 (shown in FIG. 5) are received inside the vertical rectangular tubular portion 15 without backlash. Furthermore, the slanted base plate 11*b* is arranged, for example, to deform in the front-rear direction so as to absorb dimensional variation, thus the slanted base plate 11*b* allows the L-shaped terminal 6 to be smoothly received inside the inner housing 9, while being received inside the slanted rectangular tubular portion 14.

As shown in FIG. 1 and FIG. 2B, there is provided a projecting wall 26 located at a lower side of the upper flange 16*b* and formed on an upper portion of the slanted gutter portion 14*b* of the right split inner housing 8. Furthermore, there are provided longitudinal and transverse grooves 27, 28 formed at a rear end of the projecting wall 26 for locating the later-described aluminum housing 21 (shown in FIG. 4). The projecting wall 26 is arranged to be sandwiched and fixed between the slanted gutter portion 14*b* and the later-described aluminum housing 21. Furthermore, there is provided an arm 30 (shown in FIG. 3) arranged on an upper face of the tubular portion 13 at a tip end of the tubular portion 13 for locking, for example, a later-described shield shell 29 (shown in FIG. 4).

As shown in FIG. 3, the inner housing 9 completely receives the L-shaped terminal 6 (shown in FIG. 1) and a connection portion between the crimp piece 12 (FIG. 5) and the core wire 2 (FIG. 5) of the shielded wire 1. Also, an annular portion 31*a* of a shield terminal 31 made of conductive metal is crimped and connected to the braid 4 (shown in FIG. 1) of the shielded wire 1 over the shield ring (not shown). The shield terminal 31 is provided with an elongated plate portion 31*b* projecting upward from the annular portion 31*a*, and a connection piece 31*c* arranged orthogonal to an tip end of the plate portion 31*b*. The plate portion 31*b* is arranged to contact with or adjacent to the vertical rectangular tubular portion 15 of the inner housing 9 in a parallel manner.

Figure 4:
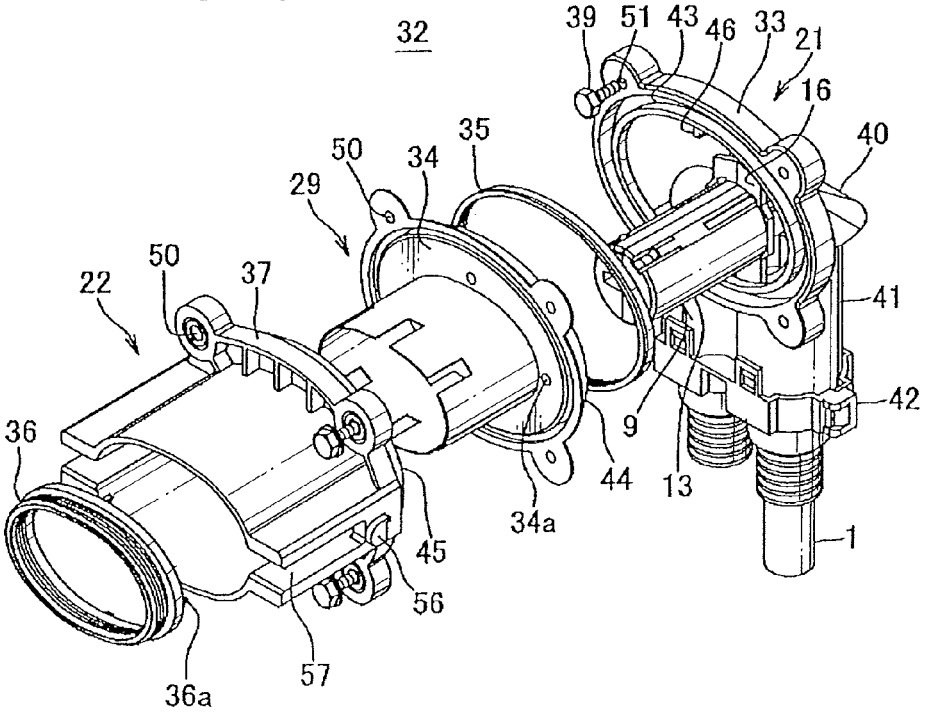
FIG. 4 is an exploded perspective view of a first embodiment of a shield connector having the insulating structure for L-shaped terminal.
Figure 5:
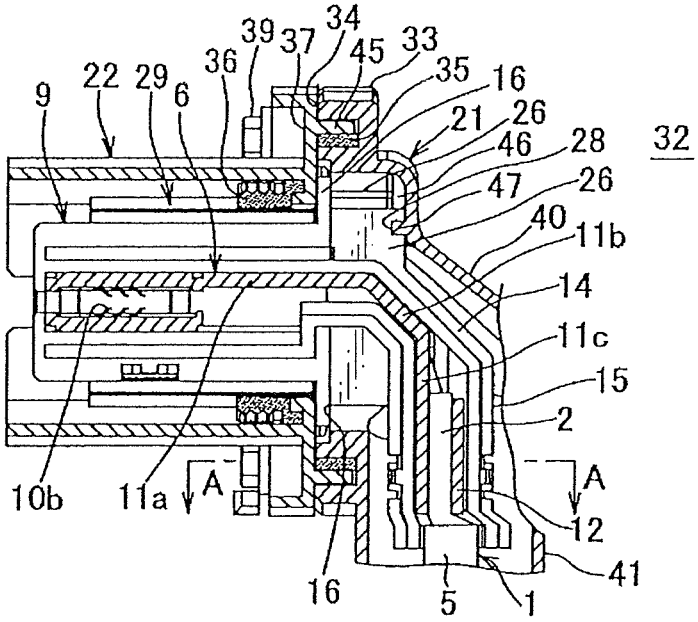
FIG. 5 is a longitudinal cross-sectional view of the shield connector.

FIG. 4 and FIG. 5 show a first embodiment of a shield connector having the above-described insulating structure for L-shaped terminal.

As shown in FIG. 4, this shield connector 32 employs a pair of inner housings 9 arranged in parallel on left and right sides (in FIG. 4, only one inner housing 9 is shown). The shield connector 32 includes the aluminum housing (or conductive housing) 21 made of conductive metal and arranged to receive the slanted and vertical rectangular tubular portions 14, 15 of the respective inner housings 9. The shield connector 32 further includes the shield shell 29 made of conductive metal, covering the horizontal tubular portion 13 of the inner housing 9 and connected to the aluminum housing. The shield connector 32 further includes an outer housing (also called a front housing) 22 made of insulating resin and covering the shield shell 29, a waterproof rubber shield packing 35 arranged between and in close-contact with a flange 33 of the aluminum housing 21 and a flange 34 of the shield shell 29, a housing packing 36 arranged between and in close-contact with the shield shell 29 and the outer housing 22, and a bolt 39 arranged to join a flange 37 of the outer housing 22 and the flange 34 of the shield shell 29 to the flange 33 of the aluminum housing 21.

Figure 6:
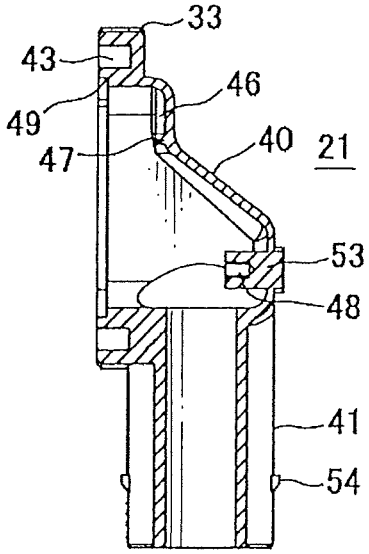
FIG. 6 is a longitudinal cross-sectional view of one embodiment of an aluminum housing of the shield connector.

As shown in FIG. 4 and FIG. 6, the aluminum housing 21 includes the ellipsoidal flange 33, a bulged wall 40 continuing to rearward of the flange 33, and a pair of tube portions 41 extending downward from the bulged wall 40. As shown in FIG. 5, the slanted and vertical rectangular tubular portions 14, 15 of each of the pair of the inner housings 9 as well as an end portion of the shielded wire 1 are received inside the bulged wall 40. Furthermore, a waterproof rubber stopper (not shown), which is inserted from outside into the outer insulating sheath 5 of the shielded wire 1, is closely-contacted with an inner face of the tube portion 41 and retained by a holder 42 made of insulating resin shown in FIG. 4.

As shown in FIG. 4, the shield packing 35 is received inside an annular groove 43 of the flange 33 of the aluminum housing 21 together with an annular projection 44 of the flange 34 of the shield shell 29 and an annular projection 45 of the flange 37 of the outer housing 22. Thus, as shown in FIG. 5, the shield packing 35 serves to prevent water from entering from outside into the aluminum housing 21 and the inner housing 9. Furthermore, the flange 34 of the shield shell 29 is connected to the flange 33 of the aluminum housing 21 by bolting (i.e. using the bolt 39). The housing packing 36 shown in FIG. 4 is fixed by fitting a protrusion 36*a* into a hole 34*a* of the flange 34 of the shield shell 29, so that the housing packing 36 is in close contact with an inner wall face of a mating connector housing (not shown) to be inserted into the outer housing 22 shown in FIG. 5.

As shown in FIG. 4, with respect to the inner housing 9, there is provided a longitudinal left-right pair of locating protrusions (or ribs) 46 formed on an upper inner face of the bulged wall 40 of the aluminum housing 21. Furthermore, as shown in FIG. 5 and FIG. 6, there is provided a transverse left-right pair of locating protrusions (or ribs) 47 formed on an inner face of the bulged wall 40 below the locating protrusion 46. Furthermore, as shown in FIG. 6, there is provided a female screw hole 48 arranged at an inner back of the bulged wall 40 for connecting and fixing the connection piece 31*c* of the shield terminal 31 (shown in FIG. 3). There is also provided a step portion 49 arranged at inner side of the flange 33 of the aluminum housing 21. As shown in FIG. 4, a bolt insertion hole 50 is provided to both of the flange 33 of the outer housing 21 and the flange 34 of the shield shell 29, and a female screw hole 51 for bolting is provided to the flange 33 of the aluminum housing 21.

In a state where the bolt 39 is fastened as shown in FIG. 5, the respective protrusions 46, 47 of the aluminum housing are engaged with the respective grooves 27, 28 of the projecting wall 26 of the inner housing 9, and the projecting wall 26 abuts on an inner face of the bulged wall 40. Furthermore, the upper and the lower flanges 16 of the inner housing 9 abut on the step portion 49 (shown in FIG. 6) of the flange 33 of the aluminum housing 21. Furthermore, the flange 37 of the outer housing 22 pushes the flange 16 of the inner housing 9 against the flange 33 of the aluminum housing 21 via the flange 34 of the shield shell 29. As a result, the flange 16 of the inner housing 9 is sandwiched and fixed between the outer housing 22 and the aluminum housing 21, and the projecting wall 26 is pushed against the aluminum housing 21 and fixed.

As shown in FIG. 5, since the L-shaped terminal 6 is closely spaced on and in contact with an inner face of the inner housing 9, the L-shaped terminal 6 can be tightly-fixed in the up-down and left-right directions without providing a locking lance. Also, since the L-shaped terminal 6 is insulated by the inner housing 9, the shield shell 29 can be arranged close to the L-shaped terminal 6, thereby saving space. In addition, since the inner housing 9 is accurately located at the aluminum housing 21 by the protrusions 46, 47 and the grooves 27, 28, and since the flange 16 and the projecting wall 26 are sandwiched between the outer housing 22 and the aluminum housing 21, the inner housing 9 can be easily and securely fixed.

Figure 7A:
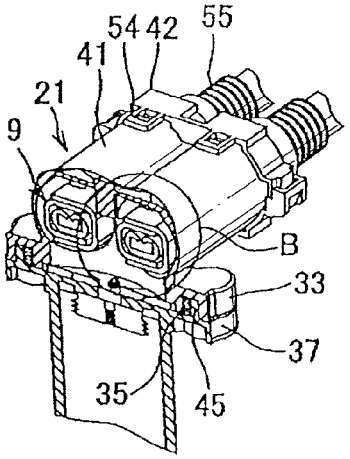
FIG. 7A is a cross-sectional perspective view taken along a line A-A of FIG. 5 showing an inner structure for the shield connector adjacent to the aluminum housing.
Figure 7B:
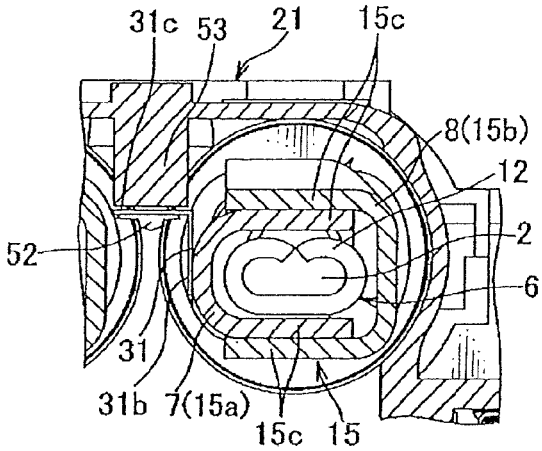
FIG. 7B is an enlarged plane view of a portion indicated by a circle B in FIG. 7A.

As shown in FIG. 7A and FIG. 7B (which shows the cross-sectional view taken along a line A-A in FIG. 5), in an assembled state of the shield connector 32, the vertical rectangular gutter portion 15*a* of one (i.e. left) split inner housing 7 engages with inside of the vertical rectangular gutter portion 15*b* of the other (i.e. right) split inner housing 8, while an inner face of the outer rectangular gutter portion 15*b* is in contact with an outer face of the inner rectangular tubular portion 15*a*. In such manner, the one rectangular gutter portion 15*a* is formed smaller than the other rectangular gutter portion 15*b*, and the rectangular gutter portions 15*a*, 15*b* are engaged together to form the rectangular tubular portion 15. Thus, by placing one rectangular gutter portion 15*a* within the other rectangular gutter portion 15*b*, the rectangular tubular portion 15 can be downsized. Also, since wall portions 15*c* of the rectangular gutter portions 15*a*, 15*b* are overlapped in the front-rear direction, the insulating performance with respect to the L-shaped terminal 6 located inside can be improved.

Since the L-shaped terminal 6 is insulated inside the rectangular tubular portion 15, the plate portion 31*b* of the shield terminal 31 can be placed in contact with the rectangular tubular portion 15, thereby saving space. The connection pieces 31*c* at an upper end of the respective right and left shield terminals 31 are symmetrically-arranged, and are connected and fixed together at the screw hole 48 (shown in FIG. 6) of a protruded wall 53 of the aluminum housing 21 using a screw 52. The holder 42, which prevents the waterproof rubber stopper to be removed from the tube portion 41 of the aluminum housing 21, is locked and fixed to the aluminum housing 21 using a locking portion 54 such as the one including a locking projection and a locking frame. In FIG. 7A and FIG. 7B, there are also shown a protection tube 55 retained by the holder 42, the core wire 2 of the shielded wire 1 and the crimp piece 12 of the L-shaped terminal 6.

Referring again to FIG. 4, the outer housing 22 is arranged such that shafts 56 on both sides of the outer housing 22 are arranged to rotatably-support an operation lever (not shown) for small insertion force, so that a driven projection of a mating connector (not shown) engages with a cam groove of the operation lever and slidably-engages with guide grooves 57 on both sides of the outer housing 22. The crimping of the L-shaped terminal 6 and the attachment of the inner housing 9, which are shown in FIG. 1, as well as the connection of the shield terminal shown in FIG. 3 are performed while the end of the shielded wire 1 is passed (inserted) through the aluminum housing 21.

Figure 8:
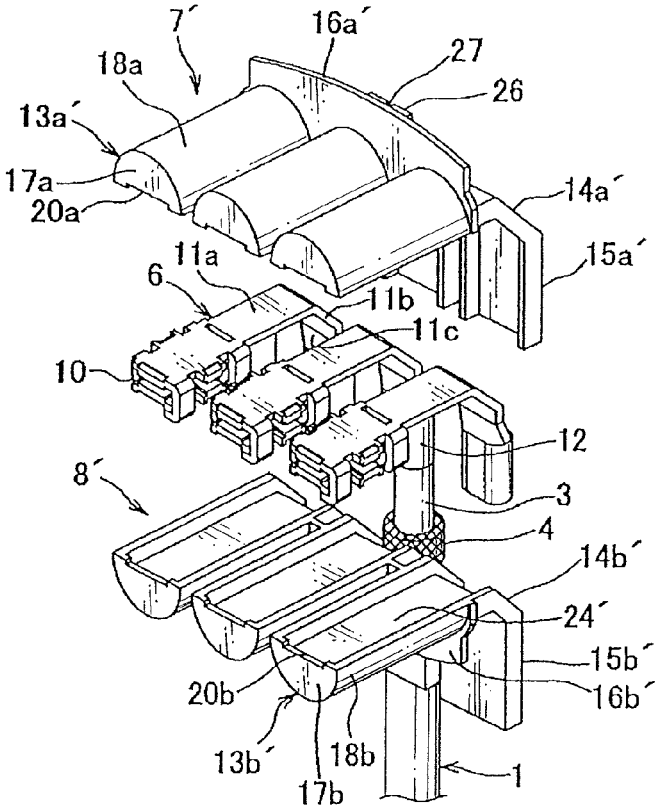
FIG. 8 is an exploded perspective view of a second embodiment of the insulating structure for L-shaped terminal according to the present invention.

Referring now to FIG. 8, there is shown a second embodiment of the insulating structure for L-shaped terminal according to the present invention. Elements similar to those of the embodiment of FIG. 1 are indicated by the like reference signs or with a prime mark to eliminate detailed explanation.

This insulating structure for L-shaped terminal employs the same L-shaped terminal 6 and the shielded wire 1 as the embodiment of FIG. 1, wherein a plurality of (three, in this embodiment) L-shaped terminals 6 crimped to the core wires 2 of the respective shielded wires 1 is received in a lump within an inner housing 9' (shown in FIG. 11) composed of a pair of upper and lower L-shaped split inner housings 7', 8' made of insulating resin. The inner housing 9' is arranged to split in a thickness direction of the L-shaped terminal 6.

Figure 9A:
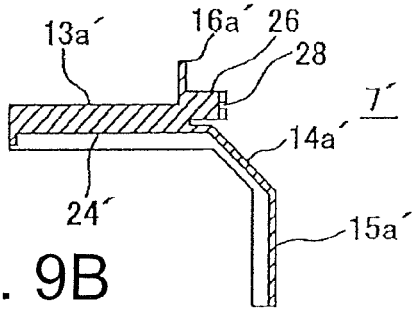
FIG. 9A is a longitudinal cross-sectional view of one embodiment of one split inner housing used in the insulating structure.

As shown in FIG. 8 and FIG. 9A, for the upper split inner housing 7', three semicylinder portions 13*a'* each having a peripheral wall 18*a* with an upward semicircular cross-section are arranged in parallel with a small space. Rear ends of the respective peripheral walls 18*a* are orthogonally-attached to an upwardly-extending wide vertical flange 16*a'*. The respective semicylinder portions 13*a'* are attached to each other by the flange 16*a'*.

The respective semicylinder portions 13*a'* include a front wall 17*a* having a horizontal, slit-like male-terminal insertion groove 20*a*, and a horizontal inner wall 24' (shown in FIG. 9) continuous with an upper side of the male-terminal insertion groove 20*a* in the peripheral wall 18*a*. The inner wall 24' passes through the flange 16*a'* and integrally continues to a short slanted rectangular gutter portion 14*a'* and a long vertical rectangular gutter portion 15*a'* on the rear side. The rectangular gutter portions 14*a'*, 15*a'* are composed of a back wall and side walls on both sides. The respective rectangular gutter portions 14*a'*, 15*a'* are arranged in parallel with a small space and are attached to each other by the horizontally-long flange 16*a'*. The projecting wall 26 is provided on an upper rear face of the flange 16*a'*. The projecting wall 26 is provided with the longitudinal and transverse grooves 27, 28 (shown in FIG. 9A) for locating a later-described aluminum housing 21'.

Figure 9B:
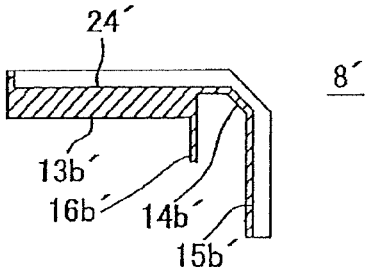
FIG. 9B is a longitudinal cross-sectional view of one embodiment of the other split inner housing used in the insulating structure.

As shown in FIG. 8 and FIG. 9B, for the lower split inner housing 8', three semicylinder portions 13*b'* each having a peripheral wall 18*b* with a downward semicircular cross-section are arranged in parallel with a small space. Rear ends of the respective peripheral walls 18*b* are orthogonally-attached to a downwardly-extending wide vertical flange 16*b*'. The respective semicylinder portions 13*b*' are attached to each other by the flange 16*b*'.

The respective semicylinder portions 13*b*' include a front wall 17*b* having a horizontal, slit-like male-terminal insertion groove 20*b*, and a horizontal inner wall 24' continuous with a lower side of the male-terminal insertion groove 20*b* in the peripheral wall 18*b*. The inner wall 24' passes through the flange 16*b*' and integrally continues to a short slanted rectangular gutter portion 14*b*' and a long vertical rectangular gutter portion 15*b*' on the rear side. The respective rectangular gutter portions 14*b*', 15*b*' are composed of a front wall and side walls on both sides. The respective rectangular gutter portions 14*b*', 15*b*' are arranged in parallel with a small space and are attached to each other by the horizontally-long flange 16*b*'.

Figure 11:
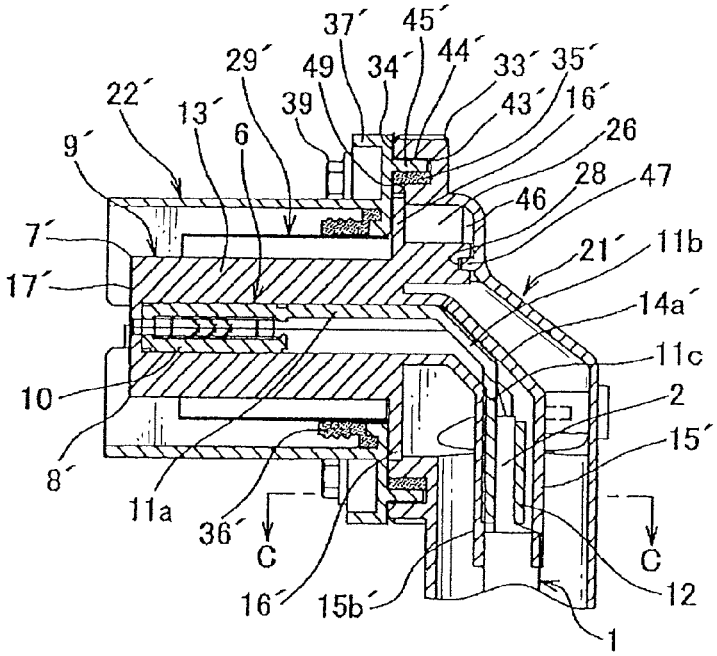
FIG. 11 is a longitudinal cross-sectional view of the shield connector.

When the upper and lower split inner housings 7', 8' are joined (combined) together, the upper and lower semicylinder portions 13*a*', 13*b*' together form a tubular portion 13' (which corresponds to an electric-contact-portion-side receiving portion) (shown in FIG. 11), and the upper and lower rectangular gutter portions 14*a*', 15*a*', 14*b*', 15*b*' together form a rectangular tubular portion 14', 15' (which corresponds to a wire-connection-portion-side receiving portion) (shown in FIG. 11). The respective split inner housings 7', 8' are locked to each other by a locking portion (not shown) such as the one including a locking claw and a locking frame. The L-shaped terminal 6 connected to the shielded wire 1 is received inside the inner housing 9' without backlash. The braid 4 of the shielded wire 1 shown in FIG. 8 is connected to the shield terminal 31 shown in FIG. 3 via an inner shield ring (not shown). The tubular portion 13' and the rectangular tubular portions 14', 15' together form a terminal receiving portion.

Figure 10:
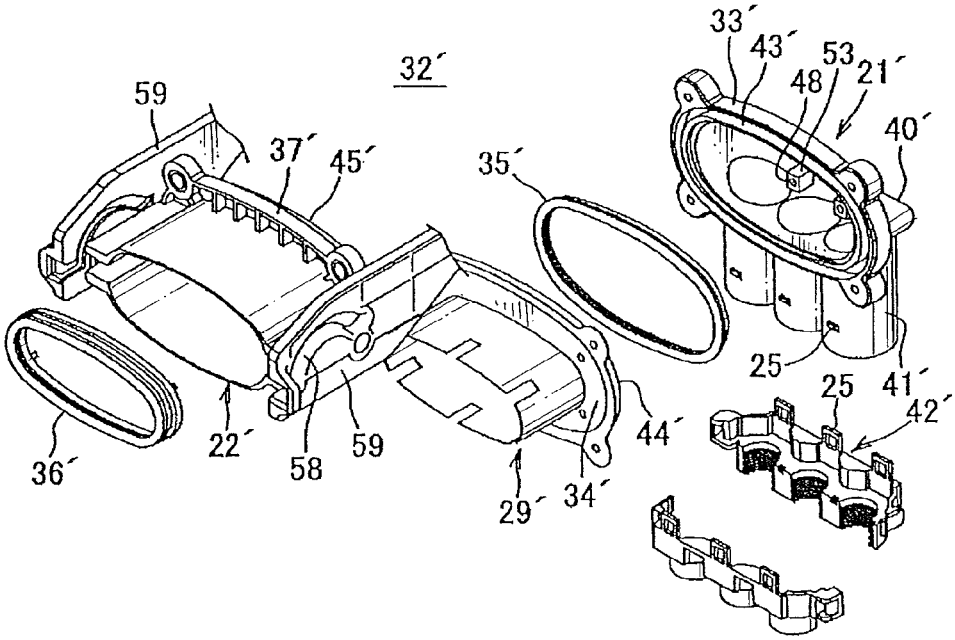
FIG. 10 is an exploded perspective view of a second embodiment of a shield connector having the insulating structure for L-shaped terminal.

FIG. 10 and FIG. 11 show a second embodiment of a shield connector having the above-described insulating structure for L-shaped terminal. In FIG. 10 and FIG. 11, elements similar to those of the embodiment of FIG. 4 are indicated by the like reference signs or with a prime mark to eliminate detailed explanation.

As shown in FIG. 10, the shield connector 32' includes the vertically-split inner housing 9' (shown in FIG. 11) receiving the L-shaped terminal 6 of FIG. 8, an aluminum housing (conductive housing) 21' for receiving the slanted and vertical rectangular tubular portions 14', 15' (shown in FIG. 11) of the inner housing 9', a shield shell 29' covering the tubular portion 13' of the inner housing 9', a shield packing 35' tightly-contacted with both of a flange 33' of the aluminum housing 21' and a flange 34' of the shield shell 29', an outer housing 22' covering the shield shell 29', a housing packing 36' tightly-contacted with both of the shield shell 29' and the outer housing 22', and a horizontally-split holder 42' for retaining a waterproof rubber stopper inside a vertical tube portion 41' of the aluminum housing 21'.

The aluminum housing 21' includes three parallely-arranged tube portions 41' corresponding to three shielded wires 1. The respective tube portions 41' communicate with a space inside a bulged wall 40'. Furthermore, there is provided a horizontally-long oval flange 33' located in front of the bulged wall 40'. As shown in FIG. 11, an annular groove 43' of the flange 33' is arranged to engage with the shield packing 35', an annular projection 44' of the flange 34' of the shield shell 29', and an annular projection 45' of the flange 37' of the outer housing 22'.

As shown in FIG. 10, there is provided two, right and left protruded walls 53 having a female screw hole 48 and arranged on an inner face of the bulged wall 40' of the aluminum housing 21'. The symmetric contact pieces 31*c* of the two shield terminals 31 (shown in FIG. 3) are fastened together by a screw at one of the female holes 48, and the contact pieces 31*c* of the rest of the shield terminals 31 are fastened to the other one of the female screw holes 48.

The flange 37' of the outer housing 22' and the flange 34' of the shield shell 29' are fastened and fixed to the flange 33' of the aluminum housing 21' by the bolt 39 of FIG. 11. While retaining a resin tube 55 (shown in FIG. 12), the holder 42' shown in FIG. 10 is locked to the tube portion 41' by a locking portion 25. Furthermore, there is provided an operation lever 59 for small insertion force rotatably-arranged on both sides of the outer housing 22' and having a cam groove 58 which engages with a driven projection of a mating connector (not shown).

As shown in FIG. 11, the L-shaped terminal 6 is received inside the L-shaped inner housing 9' without backlash. The electric contact portion 10 of the L-shaped terminal 6 is tightly-contacted with and is received in the horizontal tubular portion 13' of the inner housing 9', while the vertical base plate 11*c* and the crimp piece 12 connected to the core wire 2 are received in the vertical rectangular tubular portion 15'. A front end of the electric contact portion 10 is in contact with an inner face of a front wall 17' of the inner housing 9', the slanted base plate 11*b* is in contact with the slanted gutter portion 14*a*' of the upper split inner housing 7', and the vertical base plate 11*c* is in contact with the rectangular gutter portion 15*b*' of the lower split inner housing 8'.

The longitudinal and transverse locating protrusions 46, 47 of the aluminum housing 21' are engaged with the longitudinal and transverse grooves 27, 28 of the projecting wall 26 of the inner housing 9' to locate the inner housing 9'. Furthermore, while the upper and the lower flanges 16' of the inner housing 9' are engaged with a step portion 49 of the flange 33' of the aluminum housing 21' and sandwiched and fixed between the flange 33' of the aluminum housing 21' and the flange 37' of the outer housing 22' via the flange 34' of the shield shell 29'.

Figure 12A:
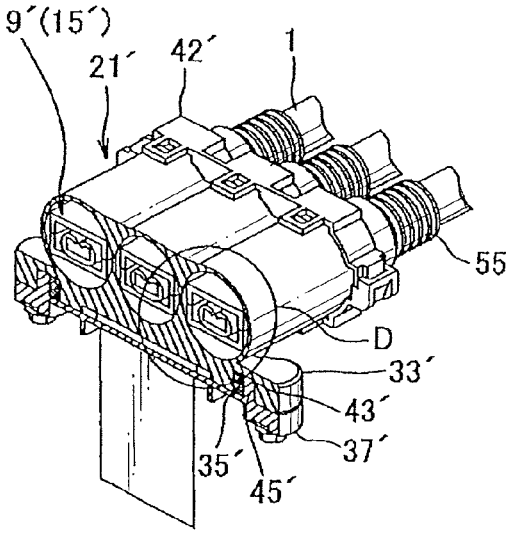
FIG. 12A is a cross-sectional perspective view taken along a line C-C of FIG. 11 showing an inner structure for the shield connector adjacent to the aluminum housing.
Figure 12B:
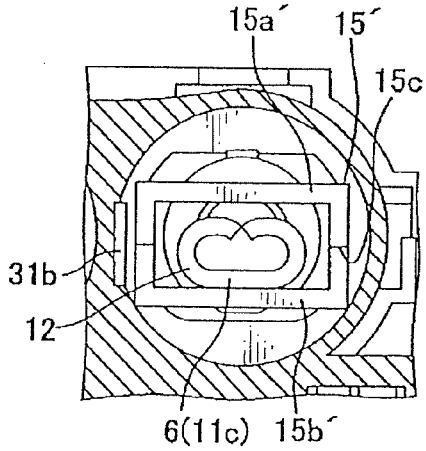
FIG. 12B is an enlarged plane view of a portion indicated by a circle D in FIG. 12A.
Figure 13:
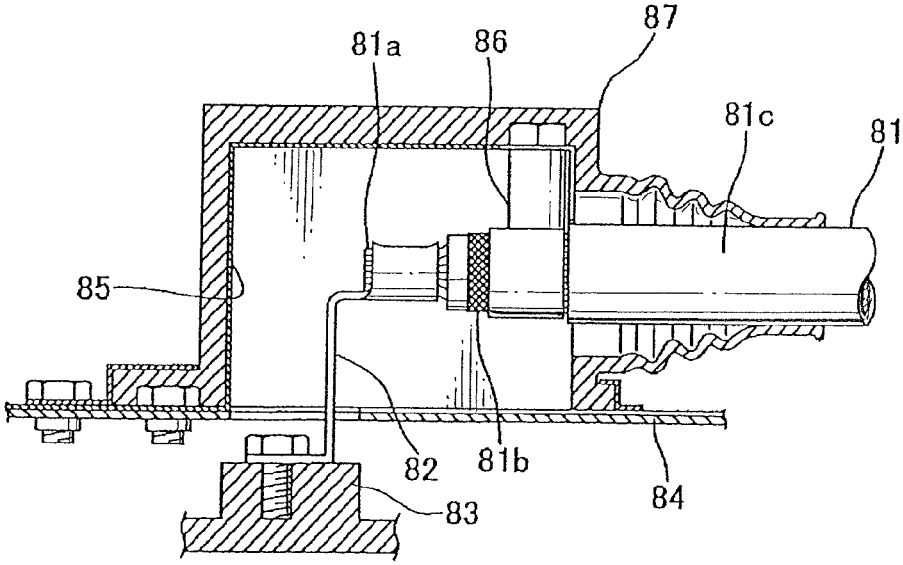
FIG. 13 PRIOR ART
FIG. 13 is a cross sectional view of one embodiment of a conventional insulating structure for L-shaped terminal.

As shown in FIG. 12A and FIG. 12B (which is the cross-sectional view taken along a line C-C of FIG. 11), the front and rear split rectangular tubular portions (rectangular gutter portion) 15*a*', 15*b*' are joined and tightly-contacted with each other at the split faces 15*c*, so that the vertical rectangular tubular portion 15' of the inner housing 9' has a complete rectangular cross-section. Since the vertical base plate 11*c* and the crimp piece 12 (i.e. a connection portion with the core wire 2 of the shielded wire 1) of the L-shaped terminal 6 are reliably insulated by the rectangular tubular portion 15' of the inner housing 9', the vertical plate portion 31*b* of the shield terminal 31 (shown in FIG. 3) can be arranged close to an outer face of the rectangular tubular portion 15'. As a result, the arrangement and the structure of the shield terminal 31, i.e. the vertical portion of the shield connector 1, can be downsized.

This arrangement has the same effect as in the case in which the electric contact portion 10 of the L-shaped terminal 6 and the horizontal plate portion 11*a* are insulated by the horizontal tubular portion 13' (shown in FIG. 11) of the inner housing 9', and in which the shield shell 29' is arranged close to the electric contact portion 10 and the tubular portion 13'.

As shown in FIG. 12A, the shield packing 35' is arranged adjacent an inner diameter of the annular groove 43' of the flange 33' of the aluminum housing 21', while an annular projection 45' of the flange 37' of the outer housing 22' is arranged adjacent to an outer diameter of the annular groove 43' via the annular projection 44' of the shield shell 29', so as to tightly-contact with the shield packing 35'. Consequently, the water is prevented from entering into the aluminum housing 21' and the inner housing 9' in a reliable and space-saving manner.

Furthermore, by receiving in a lump the plurality of L-shaped terminals 6 within the vertically-split inner housing 9', the number of components related to the split inner housings 7", 8' can be reduced, thereby simplifying and downsizing the structure while improving the workability of an assembling and fixation of the inner housing 9' to the aluminum housing 21'.

Not only useful as an insulating structure for L-shaped terminal, the present invention is also useful as a shield connector having an insulating structure for L-shaped terminal.

INDUSTRIAL APPLICABILITY

The insulating structure for L-shaped terminal according to the present invention may be utilized to improve noise prevention performance when applying high-voltage current via a connector in an electric vehicle such as a hybrid vehicle, as well as to improve ability to mount the connector within a small space in the vehicle.

REFERENCE SIGNS LIST

1 shielded wire
4 braid (shield portion)
6 L-shaped terminal
9, 9' inner housing
10 electric contact portion
12 crimp piece (wire connection portion)
13, 13' tubular portion (electric-contact-portion-side receiving portion)
14, 14', 15, 15' rectangular tubular portion (wire-connection-portion-side receiving portion)
21, 21' aluminum housing (conductive housing)
22, 22' outer housing
29, 29' shield shell
31 shield terminal

The invention claimed is:

1. An insulating structure for L-shaped terminal comprising an insulating split inner housing comprising a plurality of L-shaped terminal receiving portions including an electric-contact-portion-side receiving portion covering an electric contact portion of the L-shaped terminal connected to a shielded wire, and a wire-connection-portion-side receiving portion covering a wire connection portion of the L-shaped terminal, wherein a plurality of the electric-contact-portion-side receiving portions is covered and received by a conductive shield shell, a plurality of the wire-connection-portion-side receiving portions is covered by a conductive housing, the conductive housing is connected to the shield shell and to a shield portion of the shielded wire, the inner housing insulates the L-shaped terminal from the shield shell and the conductive housing, and the shield shell and tip end portions of the plurality of electric-contact-portion-side receiving portions projecting from the shield shell are covered by an insulating outer housing, and wherein while a flange of the inner housing projected in a radial direction in between the electric-contact-portion-side receiving portion and the wire-connection-portion-side receiving portion is held between a flange of the conductive housing and a flange of the shield shell projected in the radial direction, a flange of the outer housing projected in the radial direction is fixed to the flange of the conductive housing via the flange of the shield shell with a bolt.

2. The insulating structure for L-shaped terminal according to claim 1, wherein each of the plurality of inner housings includes the single terminal receiving portion and is designed to split in a widthwise direction of the L-shaped terminal.

3. The insulating structure for L-shaped terminal according to claim 2, wherein the shield portion of the shielded wire is connected to the conductive housing through a shield terminal, and the shield terminal is arranged close to and along the wire-connection-portion-side receiving portion of the inner housing.

4. The insulating structure for L-shaped terminal according to claim 1, wherein the single inner housing includes the plurality of terminal receiving portions attached to each other in a parallel manner, and the inner housing is designed to split in a thickness direction of the L-shaped terminal.

5. The insulating structure for L-shaped terminal according to claim 4, wherein the shield portion of the shielded wire is connected to the conductive housing through a shield terminal, and the shield terminal is arranged close to and along the wire-connection-portion-side receiving portion of the inner housing.

6. The insulating structure for L-shaped terminal according to claim 1, wherein the shield portion of the shielded wire is connected to the conductive housing through a shield terminal, and the shield terminal is arranged close to and along the wire-connection-portion-side receiving portion of the inner housing.

* * * * *